US006475027B1

(12) United States Patent
Boldt et al.

(10) Patent No.: US 6,475,027 B1
(45) Date of Patent: Nov. 5, 2002

(54) EDGE CARD CONNECTOR ADAPTOR FOR FLEXIBLE CIRCUITRY

(75) Inventors: Pierre Thorsten Boldt, Glendale, AZ (US); Thomas Dudley Belanger, Jr., Saline, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/618,937

(22) Filed: Jul. 18, 2000

(51) Int. Cl.[7] ..... H01R 9/07
(52) U.S. Cl. ..... 439/496
(58) Field of Search ..... 439/492, 496, 439/995, 357, 66, 936

(56) References Cited

U.S. PATENT DOCUMENTS

| | | | | | |
|---|---|---|---|---|---|
| 3,366,919 | A | * | 1/1968 | Gammel, Sr. et al. | 439/495 |
| 3,696,319 | A | * | 10/1972 | Olsson | 439/496 |
| 3,897,130 | A | * | 7/1975 | Donnelly et al. | 439/496 |
| 4,118,096 | A | | 10/1978 | Takahashi | |
| 4,174,560 | A | | 11/1979 | Senior et al. | |
| 4,188,086 | A | * | 2/1980 | Inouye et al. | 439/496 |
| 4,416,497 | A | | 11/1983 | Brandsness et al. | |
| 4,717,345 | A | * | 1/1988 | Gordon et al. | 439/67 |
| 4,718,859 | A | | 1/1988 | Gardner | |
| 4,784,615 | A | * | 11/1988 | Teng-Hong | 439/496 |
| 4,808,113 | A | | 2/1989 | Kanesige et al. | |
| 4,971,575 | A | * | 11/1990 | Martellotti | 439/496 |
| 5,044,980 | A | * | 9/1991 | Krumme et al. | 439/496 |
| 5,286,219 | A | | 2/1994 | Ueno et al. | |
| 5,387,125 | A | | 2/1995 | Davis et al. | |
| 5,433,632 | A | * | 7/1995 | Cherney et al. | 439/495 |
| 5,447,451 | A | | 9/1995 | Bishop | |
| 5,492,486 | A | | 2/1996 | Tanigawa | |
| 5,542,855 | A | | 8/1996 | Asai | |
| 5,611,709 | A | | 3/1997 | McAnulty | |
| 5,632,646 | A | | 5/1997 | Ii et al. | |
| 5,716,226 | A | | 2/1998 | Takahashi et al. | |
| 5,722,851 | A | | 3/1998 | Onizuka et al. | |
| 5,735,709 | A | | 4/1998 | Hashiguchi et al. | |
| 5,882,223 | A | * | 3/1999 | Igarashi | 439/495 |
| 6,264,500 | B1 | * | 7/2001 | Kawabe | 439/496 |

OTHER PUBLICATIONS

MOLEX Technical Bulletin 970 E–59, Sockets and Edge Connectors, 1 pp.

* cited by examiner

*Primary Examiner*—Brian Sircus
*Assistant Examiner*—Thanh-Tam Le
(74) *Attorney, Agent, or Firm*—John E. Kajander

(57) ABSTRACT

An adapter for interconnecting flexible circuitry, such as a length of flat flexible cable, to another electrical circuit component using an edge card connector includes a thin, substantially-flat, rigid projection that defines an edge, an upper surface and a lower surface. The flat flexible cable is secured to the upper surface of the adapter's projection and wrapped around the edge of the projection to thereby significantly improve the retention force achieved upon insertion of the adapter's projection into the edge card connector's main slot.

20 Claims, 1 Drawing Sheet

EDGE CARD CONNECTOR ADAPTOR FOR FLEXIBLE CIRCUITRY

BACKGROUND OF THE INVENTION

1. Field of the Invention

The invention relates to edge card connectors by which flexible electronic circuitry, including lengths of flat flexible cable, are interconnected with other electrical circuit components.

2. Background Art

The prior art teaches use of edge card connectors by which to provide an electrical interconnection between a rigid, planar printed circuit board and another electrical circuit component, to which the edge card connector is itself mounted. A typical edge card connector includes a connector housing having an elongate main slot within which to receive a mating edge of the circuit board. The connector housing further typically includes a plurality of secondary slots intersecting the housing's main slot. A plurality of spring contacts or terminals disposed in the secondary slots project slightly into the main slot of the housing such that, upon insertion of the mating edge of the circuit board into the main slot, the spring contacts resiliently engage respective conductive traces or plated contacts defined on one side of the circuit board.

It has recently become increasingly desirable to provide electrical assemblies which employ a flexible substrates, for example, to improve assembly packaging, or to provide integrated electrical assemblies incorporating a plurality of permanently (and flexibly) discrete, interconnected electronic modules. A need has thus arisen for a connector and method for interconnecting a flexible-substrate electrical circuit component, including lengths of flat flexible cable, to another electrical circuit component using conventional edge card connectors.

In response, for example, U.S. Pat. No. 4,808,113 teaches an adapter which, when inserted into the main slot of an edge card connector, defines a reduced-width slot within which to receive the relatively-thinner end of a length of flat flexible cable. The flat flexible cable is thereafter retained in the edge card connector by virtue of the mechanical engagement of the edge card connector's spring contacts with the cable's exposed electrically-conductive traces. Such mechanical engagement necessarily limits the "pull-out" or retention force that may be achieved using this prior art design. Moreover, because the spring contacts perform the functions of both mechanical retention and electrical conduction, a less reliable interconnection connection is achieved that may particularly impact certain relatively-high-current electrical applications, as might be found in an automotive context.

SUMMARY OF THE INVENTION

It is an object of the invention to provide an edge connector for use with flexible circuitry featuring that overcomes the aforementioned deficiencies of the prior art.

Under the invention, an adapter is provided for interconnecting flexible circuitry with an edge card connector, wherein the flexible circuitry includes a thin, flexible substrate having an edge, a first face, and a second face, and a plurality of electrical conductors on a first face of the substrate which extend towards the edge of the substrate. The adapter includes a thin, substantially-flat, rigid projection having an edge, an upper surface and a lower surface; and means, such as an adhesive layer or a mechanical interlock, for securing the second face of the substrate to the upper surface of the projection. The substrate is arranged to wrap around the edge with the substrate's second face adjacent to the lower surface of the projection.

In accordance with another feature of the invention, flexible circuitry for interconnection with an edge card connector includes a thin, flexible substrate having an edge, a first face, a second face, and a plurality of electrical conductors defined on the first face which extend towards the edge of the substrate. The flexible circuitry also includes an adapter having a thin, substantially-flat, rigid projection with an edge, an upper surface and a lower surface, wherein a first portion of the substrate proximate to the edge of the substrate is wrapped around the edge of the projection such that a second face of the flexible substrate is positioned adjacent to both the upper surface of the projection and the lower surface of the projection.

In a preferred embodiment, the second face of the flexible circuitry's substrate is secured to the upper surface of the projection, for example, by an adhesive interposed between the second face of the substrate and the upper surface of the projection, or by virtue of a suitable mechanical interlock, for example, by passing the edge of the flexible circuitry's substrate back through a slot formed in the adapter's projection. Preferably, the electrical conductors on the flexible circuitry terminate a predetermined distance from the edge of the substrate, for example, at the point where the substrate defines a bend radius as the substrate wraps around the edge of the projection.

In accordance with the invention, a method is provided for adapting thin, flexible circuitry for interconnection with an edge card connector, wherein the flexible circuitry includes a plurality of exposed electrical conductors on a first face proximate to, but, preferably, positioned a predetermined distance away from, a first edge. The method includes wrapping a first portion of the flexible circuitry proximate to its first edge around a second edge defined on a thin, substantially-flat, rigid projection of an adapter, such that a second face of the flexible circuitry is positioned adjacent to both an upper surface of the projection and a lower surface of the projection. The method further preferably includes securing the first portion of the flexible circuitry to the adapter's projection, for example, by bonding the second face of the flexible circuitry to the upper surface of the projection, or by mechanically interlocking the first portion of the flexible circuitry with the adapter.

In accordance with another feature of the invention, an exemplary method includes terminating the exposed electrically-conductive layers or traces on the on the first portion of the flexible circuitry at the point where the first portion begins to wrap around the adapter's projection.

By wrapping the flexible substrate around the projecting edge of the adapter and subsequently attaching the adapter to the edge card connector, the invention advantageously improves the retention force characteristic of the resulting connector assembly while otherwise further facilitating initial insertion of the end of the flexible circuitry into the edge card connector. When the projecting edge of the adapter is further formed of a thermally-conductive material, the invention further advantageously provides for heat transfer away from the flexible circuit/edge card connector through the adapter, for example, in higher current applications.

Other objects, features and advantages of the present invention are readily apparent from the following detailed description of the preferred embodiments when taken in connection with the accompanying drawings.

DETAILED DESCRIPTION OF THE PREFERRED EMBODIMENTS

Figure 1:
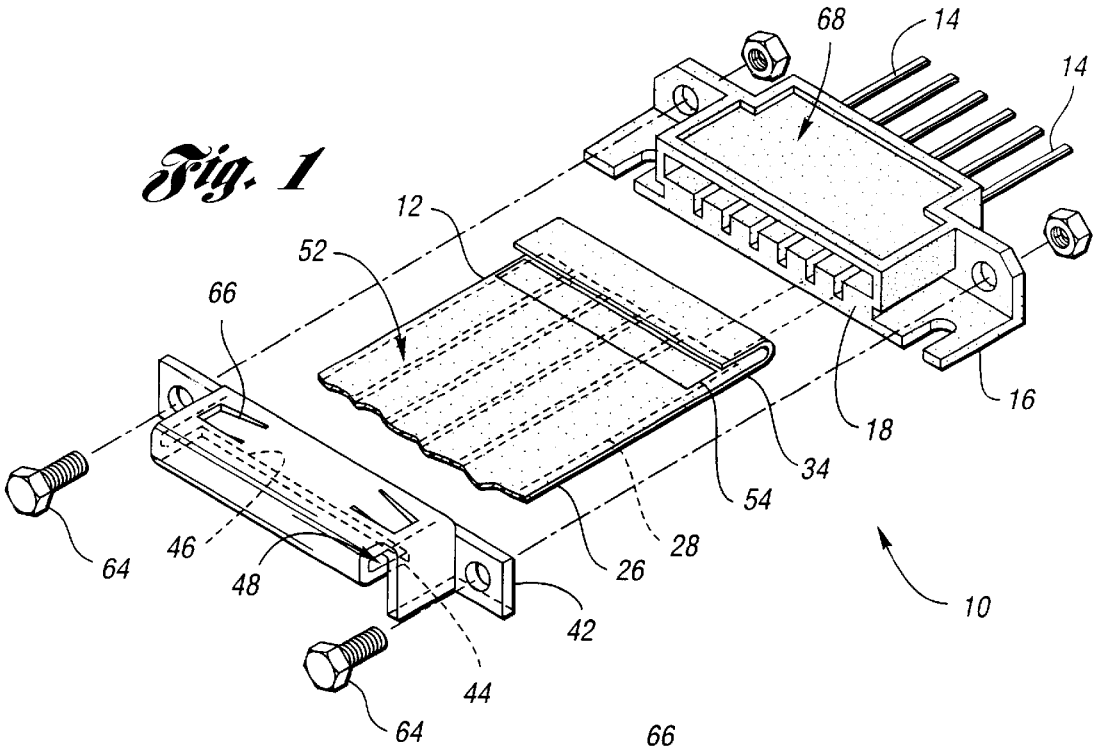
FIG. 1 is an exploded view in perspective of a first exemplary connector in accordance with the invention.

Referring to the Drawings, wherein like elements are designated using like reference numerals in each of the several views, FIG. 1 is an exploded view in perspective of a connector assembly 10 for electrically and mechanically interconnecting flexible circuitry, such as a length of flat flexible cable 12 to a plurality of round wire conductors 14. The connector assembly 10 includes an edge card connector 16 generally designed for receiving a mating edge of a rigid, planar printed circuit board (not shown), such as the edge card connector sold by Molex Incorporated of Lisle, Ill., and identified as the Model 2574 Polarized Edge Connector Housing for Crimp Terminals. The edge card connector 16 thus includes an electrically-insulative connector housing 18 having at least one elongate, main slot 20 defined in one end 22. The edge connector housing 18 further includes a plurality of transverse secondary slots 24 intersecting the main slot 20. Where desired, one or more reinforcement ribs (not shown) may bridge the main slot 20 in a known manner to provide the connector housing 18 with increased structural integrity.

Figure 2:
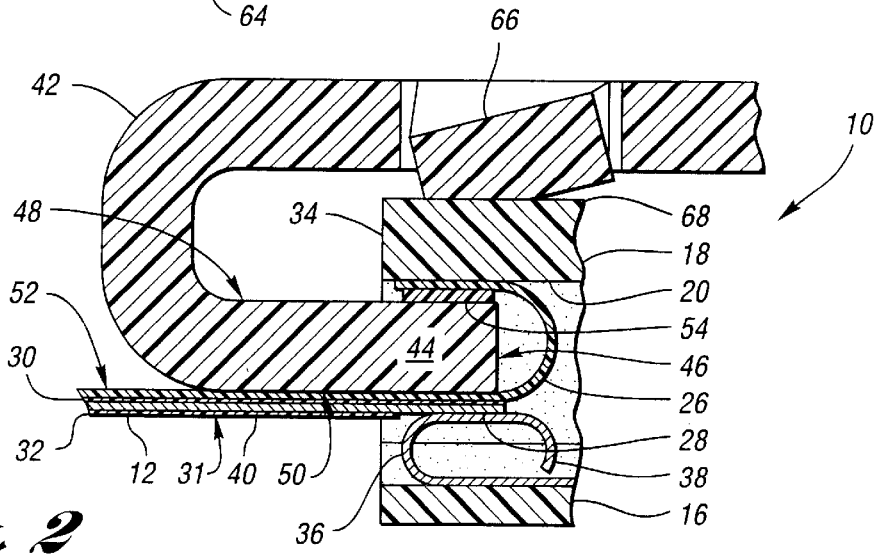
FIG. 2 is a view in cross-section of the first exemplary connector of FIG. 1.
Figure 3:
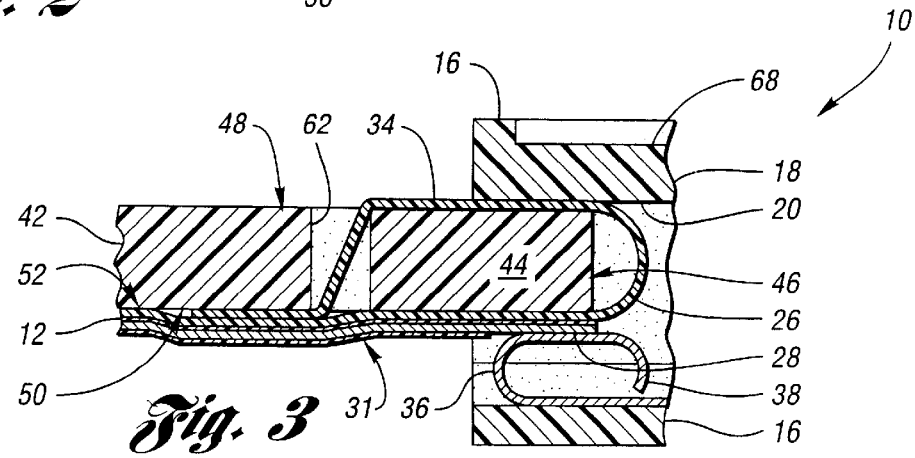
FIG. 3 is a view in cross-section of a second exemplary connector in accordance with the invention.

As best seen in FIGS. 2 and 3, the flat flexible cable 12 itself generally includes a thin flexible substrate 26 formed, for example, of a suitable material such as polyester, to which a plurality of longitudinally-extending electrical conductors, such as electrically-conductive layers or traces 28, are secured as by a suitable adhesive film 30. The nominal length of the flat flexible cable 12 includes, on the cable's first face 31, a protective overcoat 32 which has otherwise been removed from the end 34 of the cable 12 to be interconnected with the wire 14 to thereby expose the cable's electrically-conductive traces 28.

Returning to the edge card connector 16 as illustrated in cross-section in FIGS. 2 and 3, a spring contact 36 is disposed in each of the secondary slots 24. Cantilevered portion 38 of the spring contacts 26 resiliently project into the main slot 18 of the housing 16 to thereby resiliently engage exposed electrically-conductive traces 28 on a first side 40 of the flat flexible cable 12 when the cable 12 is inserted into the housing's main slot 20.

Returning to FIG. 1, and in accordance with the invention, the first exemplary connector assembly 10 further includes an adapter 42. The adapter 42 includes a substantially flat, thin projection 44 defining a first edge 46 and pair of upper and lower surfaces 48,50 proximate to the first edge 46.

Referring again to FIG. 2, the second face 52 of the flat flexible cable 12 is secured near its end 34 to the upper surface 48 of the adapter's projection 44 by an adhesive 54 or other suitable bonding material, with the cable's substrate 26 wrapping around the adapter's first edge 46 such that the cable's second face 52 is also positioned adjacent to the lower surface 50 of the adapter's projection 44. By way of example only, in the first exemplary connector assembly 10, the adhesive 54 is conveniently applied in the form of a second of double-sided tape. Significantly, because the adhesive 54 experiences little, if any, mechanical shear stress once the adapted flat flexible cable 12 is installed in the edge card connector 16, the invention advantageously avoids any special technical or durability issues with respect to the selected adhesive.

It will be appreciated that the invention contemplates use of any other suitable mechanism for securing the flat flexible cable 12 to the adapter's projection 44 such that the cable's end 34 wraps around the adapter's first edge 46, such that the cable's second face 52 is positioned adjacent both the upper and lower surfaces 48,50 of the adapter's projection, and with the cable's exposed electrically-conductive traces 30 in generally parallel-spaced relation with the projection's lower surface 50. Thus, the second exemplary connector assembly 60 illustrated in FIG. 3 features a mechanical interlock between the end 34 of the flat flexible cable 12 and the adapter's projection 44. Specifically, in the second exemplary connector assembly 60, the adapter's projection 44 includes a transverse slot 62 through which the cable's flexible substrate 26 extends, such that the first face 31 of the cable's flexible substrate 26 is positioned adjacent to the first surface 50 of the adapter's projection 44. It will be appreciated that, where desired, the invention contemplates use of both end of an adhesive 54 and a mechanical interlock to thereby secure the end 34 of the flat flexible cable 12 to the adapter 42.

In accordance with a feature of the invention, the adapter 42 is itself preferably secured to the edge card connector 16, or to another adjacent structure (not shown), by a plurality of fasteners 64. In this manner, a superior assembly retention force is obtained. Moreover, since the retention force is substantially provided by the fasteners 64 rather than the resilient spring contacts 26 of the edge card connector 16, the spring contacts 26 themselves provide an electrical connection of improved quality when compared to the prior art. Indeed, when the edge card connector 16 is provided with suitably robust spring contacts 26, a connector assembly 10 in accordance with the invention advantageously permits the use of flat flexible cable 12 with relatively thicker, higher-current-capacity conductive layers 30, as might be desired in certain automotive applications.

While the adapter is formed of any suitable material having a mechanical strength sufficient to provide reliable insertion and retention of the end 34 of the flat flexible cable 12 within the edge card connector 16, in the exemplary connector assemblies 10,60, the adapter 42 is conveniently formed from a sheet of spring steel, for reasons of reduced cost and ease of manufacturability. It will be appreciated that the thickness of the sheet stock from which the adapter is formed is suitably selected to provide the desired stack-up dimension for the selected flat flexible cable, adhesive, and nominal dimension of the edge card connector's main slot 20. As a further benefit, an adapter 42 formed of sheet steel or other suitable thermally-conductive material, such as aluminum or copper, may advantageously serve as a heat sink for the connector assemblies 10,60, thereby eliminating a common failure mode while otherwise accommodating the higher operating temperatures associated with high-current applications. It will be appreciated that the invention also contemplates forming the adapter 42 of other non-metallic thermally-conductive materials, such as alumina or berillium, as well as the use of any suitable thermally-clad materials.

An adapter 42 thus-formed of spring steel or other similar elastically-resilient material may advantageously further include a self-locking feature, for example, one or more resilient elements with which to resiliently engage a corresponding structure of the connector housing 18. Thus, as illustrated in FIGS. 1 and 2, in the first exemplary connector assembly 10, the adapter includes a pair of resilient arms 66 which engage a complementary recess 68 defined in a external surface of the connector housing 18 when the adapter's projection 44 is inserted into the housing's main slot 20.

In accordance with the invention, a method for adapting an end 34 of a flat flexible cable 12 having a plurality of electrically-conductive traces 28 exposed on a first face 31, for interconnection with an edge card connector 16, includes wrapping the end 34 of the cable 12 around an edge 46 defined on a thin, substantially-flat, substantially-rigid projection of an adapter 42. Preferably, the exposed electrically-conductive layers 28 on the cable's first face 31 terminate at the point where the cable's flexible substrate 26 begins to wrap around the first edge 46 of the adapter 42. However, to the extent that the flat flexible cable, including the exposed conductors, is formed of materials which permit at least the partial wrapping of the conductors around the adapter's edge without delaminating, the invention contemplates such wrap-around of the conductors. Alternatively, depending upon materials selection, the invention contemplates the partial local delamination and correspondingly-slight extension of the exposed conductive layer beyond the point at which the cable's flexible substrate 26 begins to wrap around the adapter's edge 46. The cable end 34 is then secured to the adapter's projection 44 in any suitable manner, as through the use of an adhesive strip 54 as illustrated in FIGS. 1 and 2, or use of a suitable mechanical interlock, as illustrated in FIG. 3.

Upon inserting the adapter-mounted flat flexible cable 12 into the main slot 20 of the edge card connector housing 18, the cantilever portions 38 of the spring contacts 36 resiliently engage respective electrically-conductive traces 28 on the first face of the flat flexible cable 12. The retention force is thereafter preferably provided by fastening or otherwise securing the adapter 42 to either the connector housing 18 or to any suitable adjacent structure (not shown).

While an exemplary system and associated methods have been illustrated and described, it should be appreciated that the invention is susceptible of modification without departing from the spirit of the invention or the scope of the subjoined claims.

What is claimed is:

1. An adapter for interconnecting flexible circuitry with an edge card connector, wherein the flexible circuitry includes a thin, flexible substrate having an edge, a first face, and a second face, and a plurality of electrical conductors on the first face of the substrate which extend towards the edge of the substrate, the adapter including:

a thin, substantially-flat, rigid projection having an edge, an upper surface and a lower surface, wherein the projection is formed of a thermally-conductive material for conducting heat away from the edge of the projection;

means for securing the second face of the substrate to the upper surface of the projection when the substrate is arranged to wrap around the edge with the second face of the substrate adjacent to the lower surface of the projection; and a mounting surface in thermal communication with the projection, whereby heat is conducted from the edge of the projection to the mounting surface, wherein the mounting surface formed with a part to be brought into pressing engagement with an adjacent structure for conduction of heat to the adjacent structure.

2. The adapter of claim 1, wherein the means for securing includes an adhesive disposed on the upper surface of the projection proximate to the edge of projection.

3. The adapter of claim 1, wherein the means for securing includes means for mechanically interlocking the edge of the substrate with the projection.

4. The adapter of claim 3, wherein the means for mechanically interlocking the edge of the substrate with the projection includes a slot formed in the projection adapted to receive the edge of the substrate.

5. The adapter of claim 1, wherein the projection is formed of metal.

6. Flexible circuitry for interconnection with an edge card connector, wherein the flexible circuitry comprises:

a thin, flexible substrate having an edge, a first face, a second face, and a plurality of electrical conductors defined on the first face which extend towards the edge of the substrate; and an adapter including a mounting surface and a thin, substantially-flat, rigid projection having an edge, an upper surface and a lower surface, wherein the projection is formed of a thermally-conductive material to define a portion of a thermally-conductive path for conducting heat from the edge of the projection to the mounting surface, wherein the mounting surface formed with a part to be brought into pressing engagement with an adjacent structure for conduction of heat to the adjacent structure, wherein a first portion of the substrate proximate to the edge of the substrate is wrapped around the edge of the projection such that the second face of the flexible substrate is positioned adjacent to both the upper surface of the projection and the lower surface of the projection.

7. Flexible circuitry according to claim 6, wherein the second face of the substrate is secured to the upper surface of the projection.

8. Flexible circuitry according to claim 7, including an adhesive interposed between the second face of the substrate and the upper surface of the projection.

9. Flexible circuitry according to claim 8, wherein the adhesive is disposed on the upper surface of the projection proximate to the edge of the projection.

10. Flexible circuitry according to claim 7, including a slot formed in the projection adapted to receive the edge of the substrate.

11. Flexible circuitry according to claim 6, wherein each of the plurality of electrical conductors terminate a predetermined distance from the edge of the substrate.

12. Flexible circuitry according to claim 11, wherein the substrate defines a bend radius as the substrate wraps around the edge of the projection, and wherein the predetermined distance is defined relative to the bend radius.

13. Flexible circuitry according to claim 6, wherein the project ion is formed of metal.

14. A method for adapting thin flexible circuitry for interconnection with an edge card connector, wherein the flexible circuitry includes a flexible substrate and a plurality of electrical conductors exposed on a first face of the substrate proximate to a first edge of the substrate, the method comprising:

wrapping a first portion of the flexible circuitry proximate to the first edge around a second edge defined on a thin, substantially-flat, rigid projection of an adapter, such that a second face of the flexible circuitry is positioned adjacent to both an upper surface of the projection and a lower surface of the projection, and conducting heat away from the substrate through the projection to a mounting surface of the adapter, wherein said mounting surface formed with a part to be brought into pressing engagement with an adjacent structure for conduction of heat to said adjacent structure.

15. The method of claim 14, further including securing the first portion of the flexible circuitry to the projection.

16. The method of claim 15, wherein securing includes bonding the second face of the flexible circuitry to the upper surface of the projection.

17. The method of claim 15, wherein securing includes mechanically interlocking the first portion of the flexible circuitry with the adapter.

18. The method of claim 14, further including exposing the plurality of electrical conductors proximate to the edge of the substrate.

19. The method of claim 18, further including terminating the exposed electrical conductors on the first portion of the flexible circuitry proximate to the first edge at a point where the first portion begins to wrap around the projection.

20. The method of claim 14, wherein securing includes bonding the second face of the flexible substrate to the upper surface of the projection.

* * * * *